US010224158B2

(12) United States Patent
Lee

(10) Patent No.: US 10,224,158 B2
(45) Date of Patent: Mar. 5, 2019

(54) KEYSWITCH DEVICE AND KEYBOARD

(71) Applicant: Chicony Electronics Co., Ltd., New Taipei (TW)

(72) Inventor: Chun-Te Lee, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 19 days.

(21) Appl. No.: 15/499,871

(22) Filed: Apr. 27, 2017

(65) Prior Publication Data

US 2018/0025863 A1 Jan. 25, 2018

(30) Foreign Application Priority Data

Jul. 22, 2016 (TW) ..... 105211129 U

(51) Int. Cl.
*H01H 13/705* (2006.01)
*H01H 13/7065* (2006.01)
*H01H 3/12* (2006.01)

(52) U.S. Cl.
CPC ..... *H01H 13/705* (2013.01); *H01H 3/125* (2013.01); *H01H 13/7065* (2013.01); *H01H 2223/054* (2013.01); *H01H 2223/056* (2013.01); *H01H 2233/03* (2013.01)

(58) Field of Classification Search
CPC ..... H01H 13/705; H01H 13/7057; H01H 13/7065; H01H 13/78; H01H 3/125; H01H 2223/054; H01H 2223/056; H01H 2223/03
See application file for complete search history.

(56) References Cited

U.S. PATENT DOCUMENTS 3,678,424 A * 7/1972 Iwashima ..... H01H 13/70 200/345
4,678,880 A * 7/1987 Koizumi ..... H01H 13/705 200/305
5,813,778 A * 9/1998 Shih ..... G06F 3/0202 400/473
5,874,696 A * 2/1999 Hayashi ..... G06F 1/1616 200/345
5,901,837 A * 5/1999 Aimi ..... H01H 3/125 200/344
6,833,522 B1 * 12/2004 Park ..... H01H 3/125 200/17 R
9,368,300 B2 * 6/2016 Casparian ..... H01H 13/83
9,767,970 B2 * 9/2017 Jhuang ..... H01H 13/023
9,799,465 B2 * 10/2017 Jhuang ..... H01H 13/14
9,941,070 B2 * 4/2018 Liu ..... H05K 999/99
2016/0322180 A1 * 11/2016 Jhuang ..... H01H 3/125

* cited by examiner

*Primary Examiner* — Felix O Figueroa
(74) *Attorney, Agent, or Firm* — CKC & Partners Co., LLC

(57) ABSTRACT

A keyswitch device includes a circuit board, a fixing bracket, a micro switch, a keycap, and a connecting assembly. The circuit board has a first surface and a second surface opposite to the first surface. The fixing bracket includes a main body and a first hook. The main body abuts against the first surface. The first hook is connected to the main body and fixed to the circuit board. The micro switch passes through the main body, and is disposed on the circuit board and configured to generate a pressing signal to the circuit board while being pressed. The keycap is supported on the micro switch and configured to press the micro switch toward the circuit board. The connecting assembly is connected between the fixing bracket and the keycap and configured to guide the keycap to move upward and downward relative to the circuit board.

32 Claims, 7 Drawing Sheets

KEYSWITCH DEVICE AND KEYBOARD

This application claims priority to Taiwan Application Serial Number 105211129, filed Jul. 22, 2016, which is herein incorporated by reference.

BACKGROUND

Field of Invention

The present disclosure relates to a keyswitch device and a keyboard.

Description of Related Art

Currently, the keyboard is one of the indispensable input devices to enter text or numbers while using a PC. Moreover, consumer electronic products used in daily life or large-scale processing equipment used in the industrial sector all require key structure units input devices to operate.

Currently, regarding the conventional keyboard commonly includes a bottom plate, a membrane circuit broad, a connecting assembly, a keycap and a restoring member (for example, a rubber elastic member) and the connecting assembly is connected between the bottom plate and the keycap. However, for a well-developed consumer electronic product, if a new framework can be provided to reduce the overall amount of the components while with the original functionality preserved, the relative manufacturing costs can be further reduced. Accordingly, how to provide a keyswitch device and a keyboard to solve the aforementioned problems becomes an important issue to be solved by those in the industry.

SUMMARY

Accordingly, an aspect of the disclosure is to provide a keyswitch device and a keyboard that can effectively reduce the overall amount of components.

According to an embodiment of the disclosure, a keyswitch device includes a circuit board, a fixing bracket, a micro switch, a keycap and a connecting assembly. The circuit board has a first surface and a second surface opposite to the first surface. The fixing bracket includes a main body and a first hook. The main body abuts against the first surface. The first hook is connected to the main body and is fixed to the circuit board. The micro switch is disposed on the circuit board passing through the main body and configured to generate a pressing signal to the circuit board while being pressed. The keycap is supported on the micro switch and configured to press the micro switch toward the circuit board. The connecting assembly is connected between the fixing bracket and the keycap and configured to guide the keycap to move upward and downward relative to the circuit board.

In an embodiment of the disclosure, the circuit board further includes a through hole communicating the first surface and the second surface. The first hook abuts against the second surface via the through hole.

In an embodiment of the disclosure, the main body slidably abuts against the first surface, so as to make the first hook selectively abut against or leave the second surface.

In an embodiment of the disclosure, the fixing bracket further includes a second hook. The micro switch includes a pedestal and a push button. The pedestal is disposed on the circuit board and has a positioning hole. The push button supports the keycap and is engaged with the pedestal. The push button is configured to move toward or away from the pedestal. The second hook is engaged with the positioning hole when the first hook abuts against the second surface. The second hook is separated from the positioning hole when the first hook is separated from the second surface.

In an embodiment of the disclosure, the first hook and the second hook located at opposite side of the main body.

In an embodiment of the disclosure, the positioning hole is located at a peripheral edge of the pedestal.

In an embodiment of the disclosure, the circuit board further includes an engaging hole. The engaging hole is configured to be engaged with the peripheral edge of the pedestal.

In an embodiment of the disclosure, the fixing bracket further includes a plurality of third hooks. The third hook is connected to the main body and configured to be engaged with the connecting assembly.

In an embodiment of the disclosure, the push button has an abutting portion. The abutting portion extends to the pedestal. The micro switch further includes a first terminal and a second terminal. The first terminal is disposed on the pedestal and electrically connected to the circuit board. The second terminal is disposed on the pedestal, electrically connected to the circuit board and is opposite to the first terminal. When the push button moves toward the pedestal to make the abutting portion abut against the second terminal, the second terminal is then moved toward the first terminal to electrically connect to the first terminal, so as to generate a pressing signal.

In an embodiment of the disclosure, the micro switch further includes a restoring member. The restoring member is disposed between the pedestal and the push button.

In an embodiment of the disclosure, the fixing bracket comprises metal. The circuit board further includes a grounding pad. The grounding pad is disposed on the second surface and adjacent to the through hole. The grounding pad is configured to electrically contact to the first hook abutting against the second surface.

According to another embodiment of the disclosure, a keyboard includes a circuit board and a plurality of keyswitch assemblies. The circuit board has a first surface and a second surface opposite to the first surface. Each of the keyswitch assemblies includes a fixing bracket, a micro switch, a keycap and a connecting assembly. The fixing bracket includes a main body and a first hook. The main body abuts against the first surface. The first hook is connected to the main body and fixed to the circuit board. The micro switch is disposed on the circuit board passing through the main body and configured to generate a pressing signal to the circuit board while being pressed. The keycap is supported on the micro switch and configured to press the micro switch toward the circuit board. The connecting assembly is connected between the fixing bracket and the keycap and configured to guide the keycap to move upward and downward relative to the circuit board.

Accordingly, in the keyswitch device and the keyboard of the present disclosure, the micro switch is used to support the keycap and generate a pressing signal correspondingly while the keycap is pressed. Therefore, the conventional membrane circuit board and restoring member can be replaced by the micro switch. Also, a hook is designed on the fixing bracket of the keyswitch device and the keyboard to hook downward to the circuit board, so the conventional adhesive layer used to fix the circuit board and the fixing bracket can be omitted. Moreover, in the keyswitch device and the keyboard of the present disclosure, a hook is designed on the fixing bracket to engage with the positioning hole set on the micro keyswitch, so as to prevent the micro switch disposed on the circuit board from floating or skewing. Furthermore, the keyswitch device and the keyboard of the present disclosure, a grounding pad can be disposed on the location where the circuit board is hooked by the hook of the fixing bracket, so as to gain some additional properties such as grounding and anti-static.

It is to be understood that both the foregoing general description and the following detailed description are by examples, and are intended to provide further explanation of the invention as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
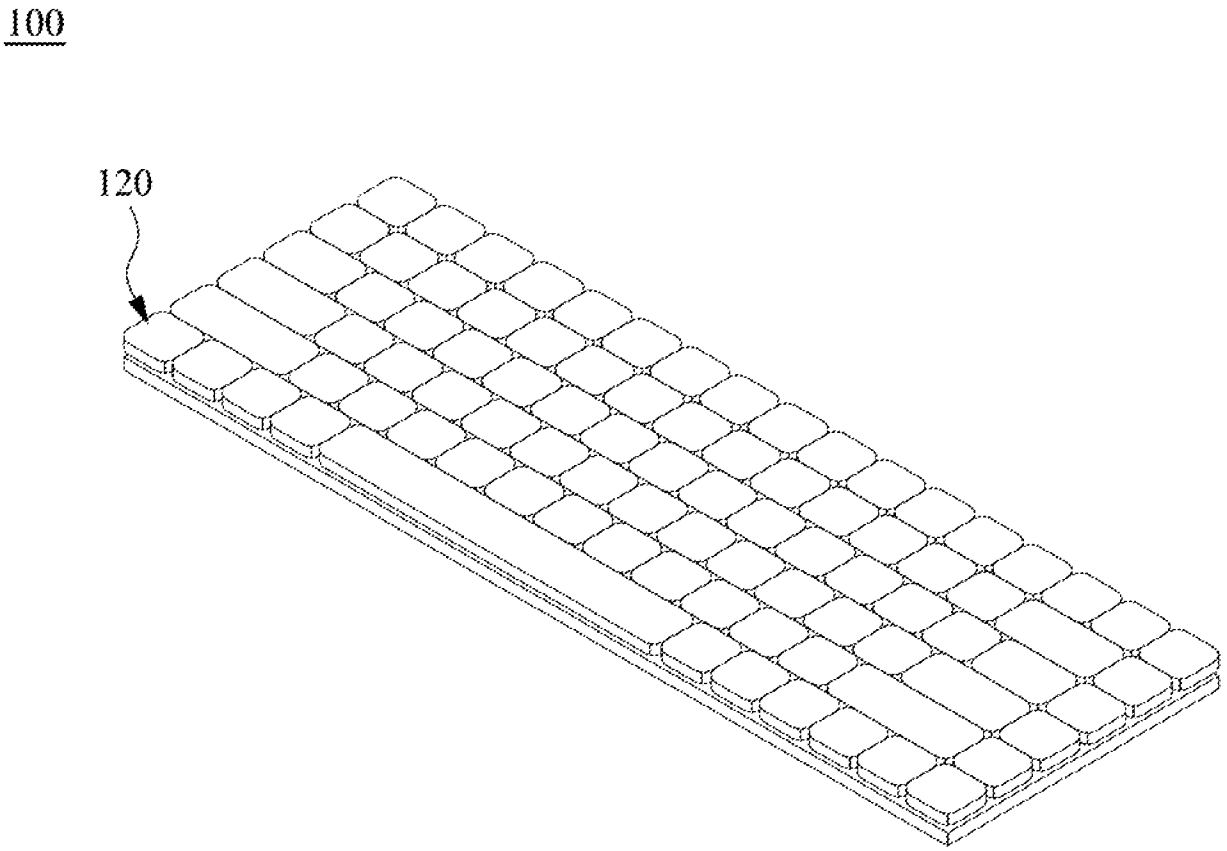
FIG. 1 is a three-dimensional view of the keyboard according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Reference is made to FIG. 1. FIG. 1 is a three-dimensional view of a keyboard 100 according to an embodiment of the disclosure. As shown in FIG. 1, the keyboard 100 of the disclosure can be an external keyboard (e.g., a keyboard with a PS/2 interface or a keyboard with a USB interface) used in a desktop computer, or can be a part of a computer system having an input device that is in the form of a keyboard (e.g., a notebook computer or a laptop computer), but the disclosure is not limited in this regard. That is, the keyboard 100 of the disclosure can be used in any electronic products that adopted keyswitch devices to be the input interface.

Figure 2:
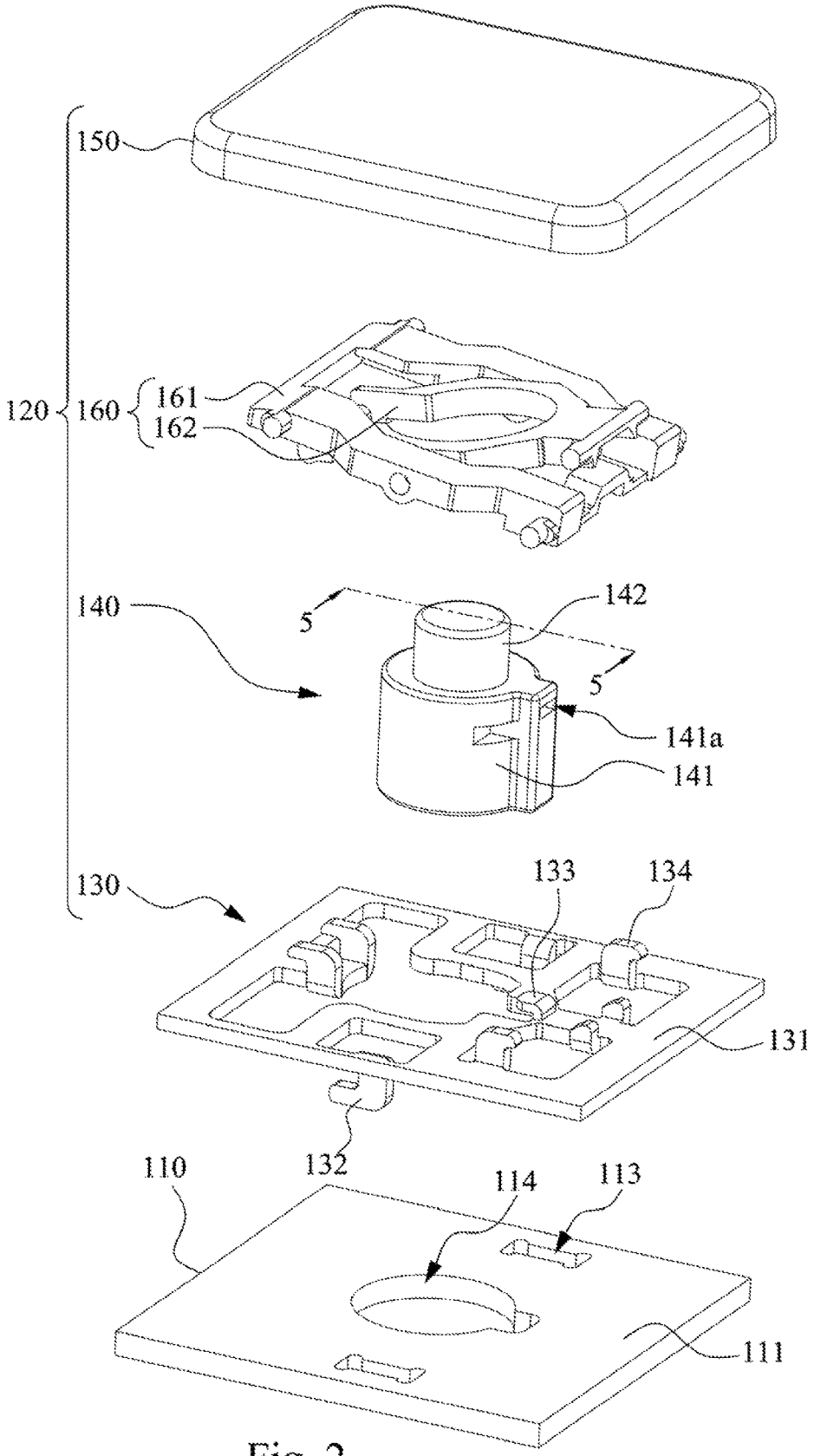
FIG. 2 is a partial exploded view of the keyboard according to one embodiment of the present disclosure.

Reference is made to FIG. 2. FIG. 2 is a partial exploded view of the keyboard 100 according to an embodiment of the disclosure. As shown in FIG. 2, in the embodiment, the keyboard 100 includes a circuit board 110 and a plurality of keyswitch assemblies 120 (FIG. 2 depicts one keyswitch assembly as a representative), in which a combination of the circuit board 110 and one keyswitch assembly 120 can be regarded as an individual keyswitch device. Each keyswitch assembly 120 includes a fixing bracket 130, a micro switch 140, a keycap 150, and a connecting assembly 160. The fixing bracket 130 is disposed on the circuit board 110. The micro switch 140 is disposed on the circuit board 110 passing through the fixing bracket 130 and configured to generate a pressing signal to the circuit board 110 while being pressed. The keycap 150 is supported on the micro switch 140 and configured to press the micro switch 140 toward the circuit board 110. The connecting assembly 160 is connected between the fixing bracket 130 and the keycap 150 to guide the keycap 150 to move upward and downward relative to the circuit board 110.

Figure 3A:
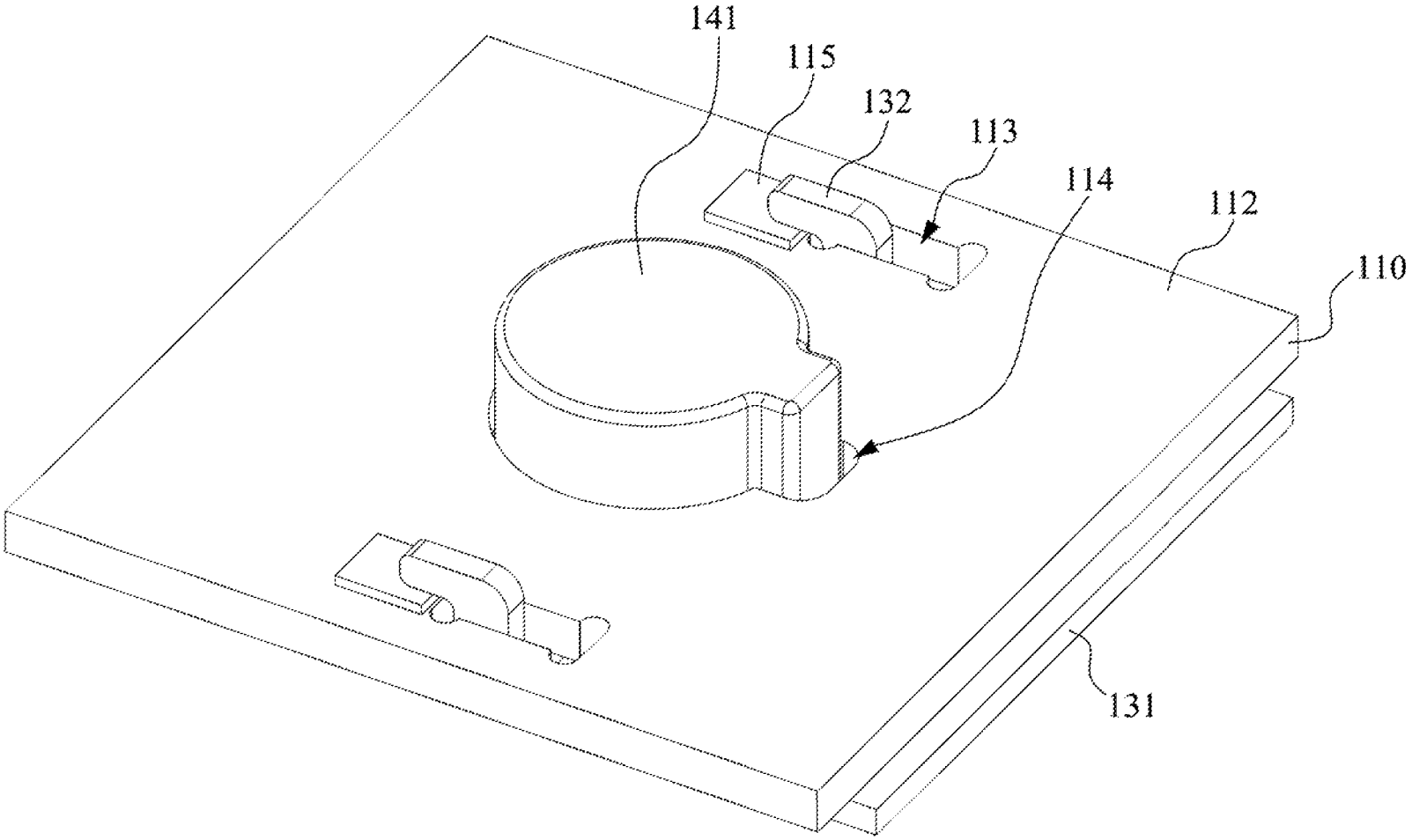
FIG. 3A is a stereo assembly drawing of the circuit board, the fixing bracket, and the micro switch in FIG. 2.
Figure 3B:
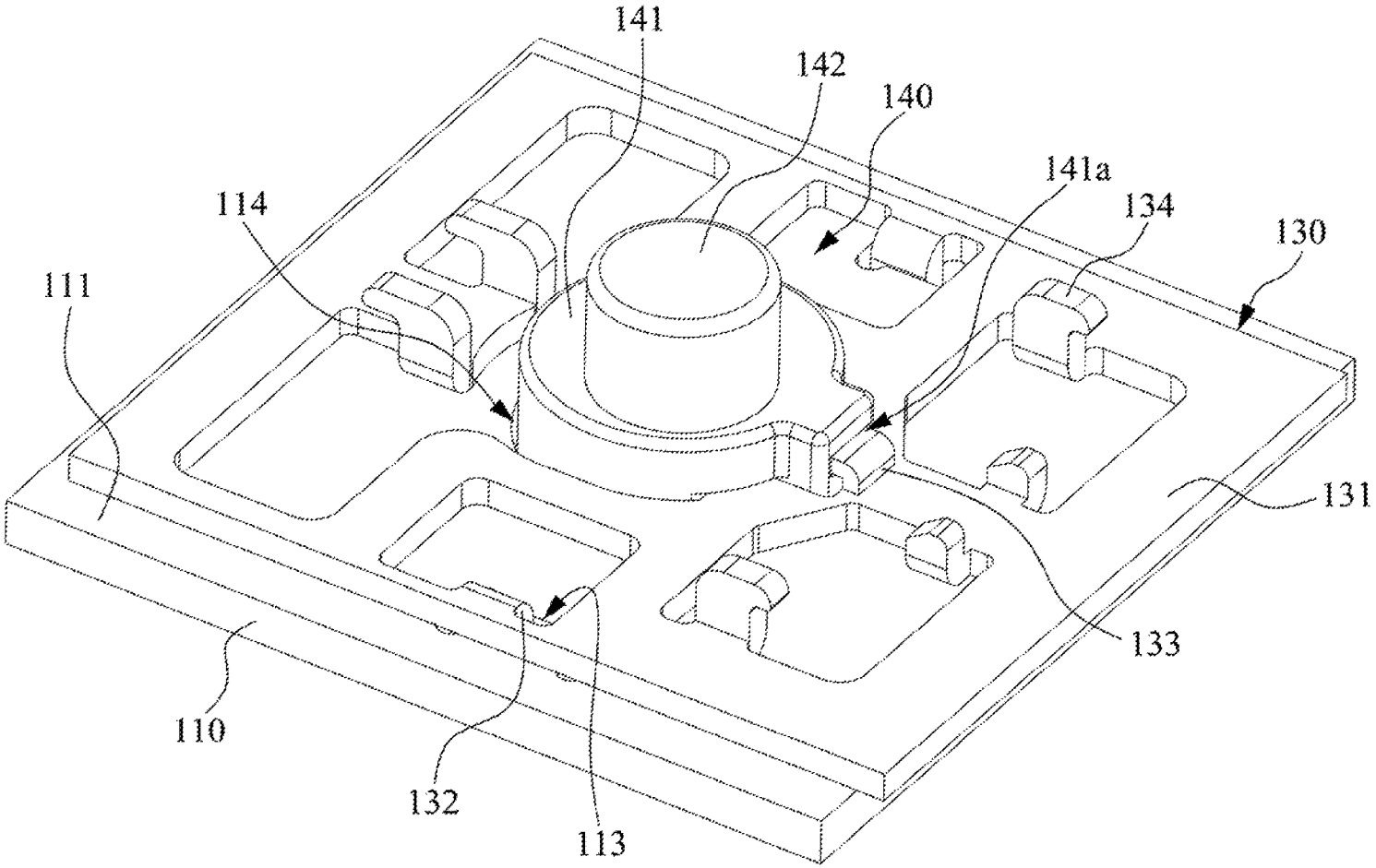
FIG. 3B is a stereo assembly drawing of the structure in FIG. 3A in another perspective.
Figure 4A:
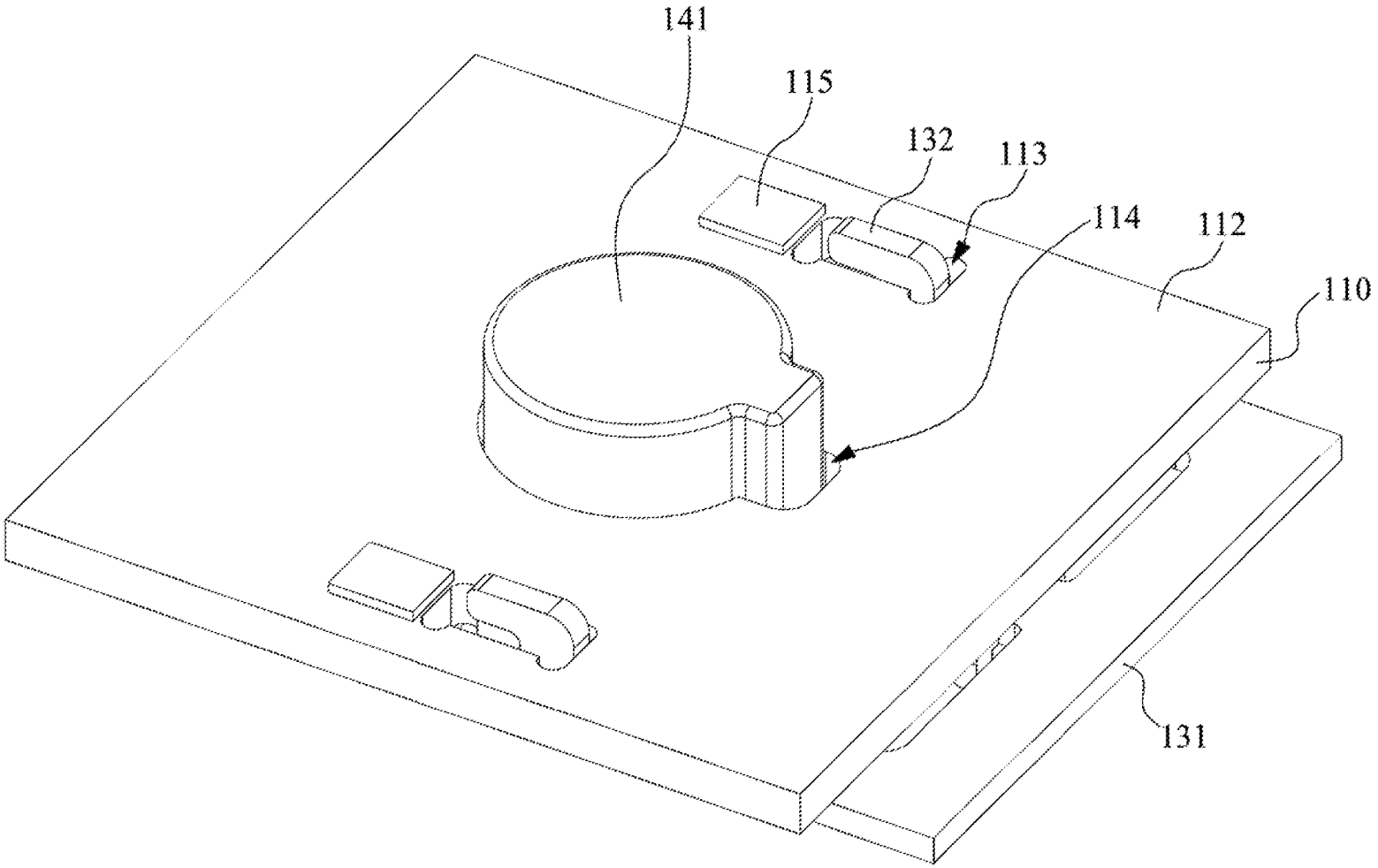
FIG. 4A is another stereo assembly drawing of the circuit board, the fixing bracket, and the micro switch in FIG. 2.
Figure 4B:
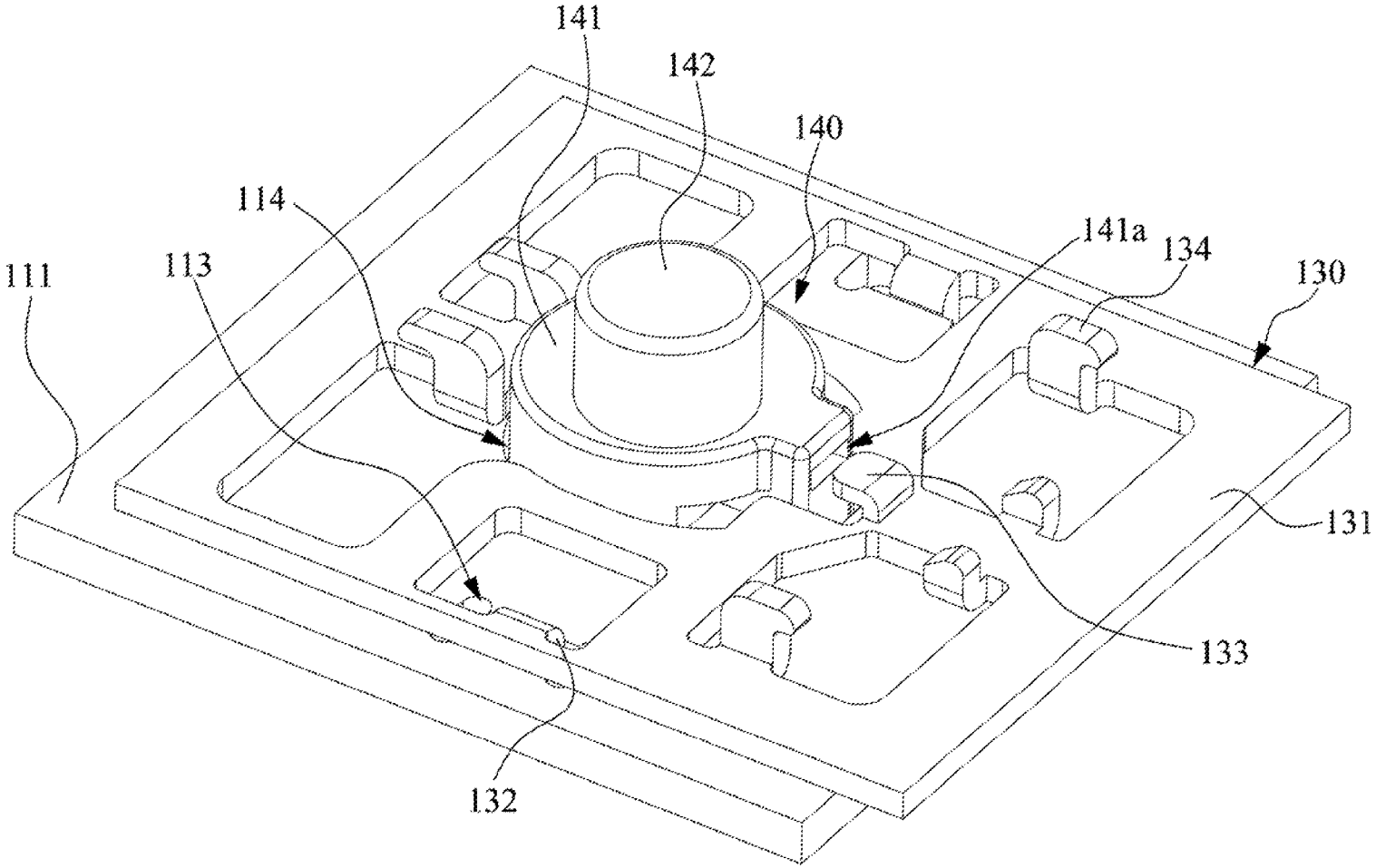
FIG. 4B is a stereo assembly drawing of the structure in FIG. 4A in another perspective.

Reference is made to FIG. 3A, FIG. 3B, FIG. 4A, and FIG. 4B. FIG. 3A is a stereo assembly drawing of the circuit board 110, the fixing bracket 130, and the micro switch 140 in FIG. 2. FIG. 3B is a stereo assembly drawing of the structure in FIG. 3A in another perspective. FIG. 4A is another stereo assembly drawing of the circuit board 110, the fixing bracket 130, and the micro switch 140 in FIG. 2. FIG. 4B is a stereo assembly drawing of the structure in FIG. 4A in another perspective. As shown in FIG. 2 to FIG. 4B, in the embodiment, the circuit board 110 has a first surface 111 and a second surface 112 opposite to the first surface and a plurality of through holes 113 (FIG. 2 depicts two through holes as representatives) communicating the first surface 111 and the second surface 112. The fixing bracket 130 includes a main body 131 and two first hooks 132. The two first hooks 132 correspond to the two through holes 113. The main body 131 abuts against the first surface 111. The first hook 132 is connected to the main body 131 and abuts against the second surface 112 via the corresponding through hole 113. Specifically, after the first hook 132 of the fixing bracket 130 passes through the through hole 113 of the circuit board 110, the fixing bracket 130 can slide relative to the circuit board 110. Therefore, the main body 131 slidably abuts against the first surface 111, so as to make the first hook 132 selectively abut against the second surface 112 (as shown in FIG. 3A) or leave the second surface 112 (as shown in FIG. 4A).

According to the aforementioned configuration, in the keyswitch device and the keyboard 100 in the embodiment, a hook is designed on the fixing bracket 130 to hook downward to the circuit board 110, so the conventional adhesive layer used to fix the circuit board 110 and the fixing bracket 130 can be omitted.

Moreover, as shown in FIG. 2, in the embodiment, the circuit board 110 has an engaging hole 114 and the engaging hole 114 is configured to engage with a peripheral edge of the pedestal 141 of the micro switch 140. The fixing bracket 130 further includes a second hook 133. The micro switch 140 includes a pedestal 141 and a push button 142. The pedestal 141 is disposed on the circuit board 110 and has a positioning hole 141*a*. The push button 142 supports the keycap 150 and is engaged with the pedestal 141. The push button 142 is configured to move toward or away from the pedestal 141. When the bracket slides on the circuit board 110 and makes the first hook 132 abut against the second surface 112, the second hook 133 will engage with the positioning hole 141*a* (as shown in FIG. 3B). Comparatively, when the bracket slides on the circuit board 110 and makes the first hook 132 leave the second surface 112, the second hook 133 will leave the positioning hole 141*a* (as shown in FIG. 4B).

According to the aforementioned configuration, the keyswitch device and the keyboard 100 in the embodiment not only use the engaging hole 114 of the circuit board 110 to limit the relative horizontal displacement of the micro switch 140 and the circuit board 110, but also designed a hook on the fixing bracket 130 to hook into the positioning hole 141*a* on the micro switch 140 to limit the relative vertical displacement of the micro switch 140 and the circuit board 110. As a result, the floating or skewing problems of the micro switch 140 disposed on the circuit board 110 can be effectively prevented.

Furthermore, the peripheral contour of the micro switch 140 is non-circular and is matched with the inner contour of the engaging hole 114 of the circuit board 110, so as to prevent the micro switch 140 from rotating relative to the engaging hole 114 of the circuit board 110.

As shown in FIG. 3A and FIG. 4A, in the embodiment, the fixing bracket 130 comprises metal. The circuit board 110 further includes a grounding pad 115. The grounding pad 115 is disposed on the second surface 112 and adjacent to the through hole 113. The grounding pad 115 is configured to electrically contact the first hook 132 abutting against the second surface 112. By the configuration of the keyswitch device and the keyboard 100 in the disclosure, the grounding pad 115 can be disposed on the position where the circuit board 110 is hooked by the first hook 132 of the fixing bracket 130 to gain additional properties such as grounding and anti-static.

As shown in FIG. 2, in the embodiment, the first hook 132 and the second hook 133 is located at the opposite sides of the main body 131 (that is, the first hook 132 is at the underside of the main body 131 and the second hook 133 is at the upper side of the main body 131), but the disclosure is not limited in this regard. In practical application, the second hook 133 can be coplanar with the main body 131, and the position of the positioning hole 141*a* on the pedestal 141 is adjusted according to the position of the second hook 133 for the second hook 133 to plunge in.

As shown in FIG. 2, in the embodiment, the positioning hole 141*a* is located at a peripheral edge of the pedestal 141, but the disclosure is not limited in this regard. In practical application, there is no positioning hole 141*a* on the pedestal 141, and the second hook 133 can extend upward and be configured to abut against or leave the top surface of the pedestal 141 selectively, so the relative vertical displacement of the micro switch 140 and the circuit board 110 can be limited as well.

In practical application, the pedestal 141 of the micro switch 140 can be combined with the circuit board 110 by welding, but the disclosure is not limited in this regard.

As shown in FIG. 2, in the embodiment, a scissor-like bracket assembly is implemented as the connecting assembly 160, but the disclosure is not limited in this regard. Specifically, the fixing bracket 130 is connected to the bottom of the connecting assembly 160 and the keycap 150 is connected to the top of the connecting assembly 160. More specifically, the fixing bracket 130 further includes a plurality of third hooks 134. The third hook 134 is connected to the main body 131 and configured to be engaged with the connecting assembly 160. The connecting assembly 160 includes a first connecting member 161 and a second connecting member 162. The first connecting member 161 and the second connecting member 162 pivotally connect with each other. In the embodiment, the first connecting member 161 and the second connecting member 162 are both in frame shape, and the peripheral edge of the second connecting member 162 is pivotally connected within the inner edge of the first connecting member 161, but the disclosure is not limited in this regard.

In practical application, the connecting assembly 160 can be replaced by other bracket structures with similar functionality (that is, to guide the keycap 150 to move upward or downward relative to the circuit board 110), i.e., V-shape, A-shape, or two parallel linkage mechanism.

Moreover, beneath the keycap 150 and inside the inner edge of the second connecting member 162, there forms a holding space for the micro switch 140 to be disposed within. While the keycap 150 is pressed by an external force, there is a resistant force generated by the micro switch 140 to provide the user a feeling of pressing, and the keycap 150 is moved to the minimum position guided by the connecting assembly 160. When the external force on the keycap 150 is released, the keycap 150 is restored to the maximum position by the resistant force generated by the micro switch 140. The working principle of generating resistant force by the micro switch 140 will be explained in the following.

Figure 5:
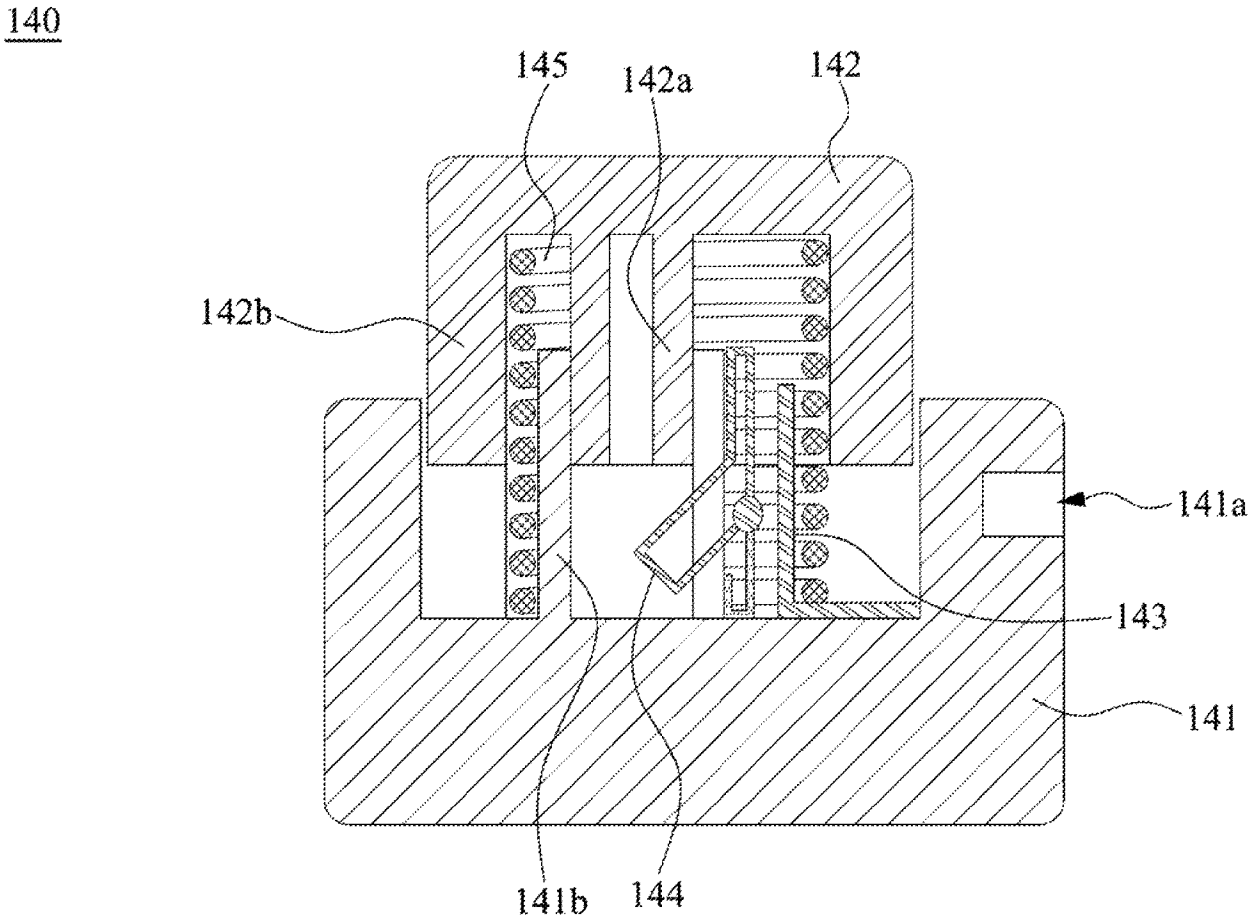
FIG. 5 is a cross-sectional view of the micro keyswitch taken along line 5-5 in FIG. 2.

Reference is made to FIG. 5. FIG. 5 is a cross-sectional view along the line 5-5 of the micro switch 140 in FIG. 2. As shown in FIG. 2 and FIG. 5, in the embodiment, the circuit board 110 has an engaging hole 114. The engaging hole 114 is configured to engage with the pedestal 141 of the micro switch 140. In practical application, the pedestal 141 of the micro switch 140 can be welded with the circuit board 110, but the disclosure is not limited in this regard.

As shown in FIG. 5, the push button includes an abutting portion 142*a*. The abutting portion 142*a* extends toward the pedestal 141. The micro switch 140 further includes a first terminal 143 and a second terminal 144. The first terminal is disposed on the pedestal 141 and electrically connected to the circuit board 110 (i.e., passing through the pedestal 141). The second terminal 144 is disposed on the pedestal 141 and electrically connected to the circuit board 110 (i.e., passing through the pedestal 141), and is opposite to the first terminal 143. When the push button 142 moves toward the pedestal 141 to make the abutting portion 142*a* abut against the second terminal 144, the second terminal 144 is then moved toward the first terminal 143 to electrically connect to the first terminal 143, so as to generate a pressing signal.

In practical details, in the embodiment, the restoring member 145 is disposed between the pedestal 141 and the push button 142. In this way, when the keycap 150 is pressed by an external force, the restoring member 145 can generate a resistant force to support the keycap 150 (through the push button 142), so as to provide the user a feeling of pressing. When the external force being released from the keycap 150, the keycap 150 will be restored to the maximum position by the resistant force generated by the restoring member 145.

Moreover, the pedestal 141 further includes a limit column 141*b*. The limit column 141*b* is hollow and suits the abutting portion 142*a* of the push button 142, so the abutting portion 142*a* can move upward and downward relative to the limit column 141*b*, by this way to guide the push button 142 to move toward or away from the pedestal 141. In addition, the push button 142 further includes an enclosure portion 142*b*. The enclosure portion 142*b* encloses the abutting portion 142*a* and is set outside the limit column 141*b*. The restoring member 145 is set outside the limit column 141*b* and limited within the enclosure portion 142*b*, so as to maintain the position of the restoring member 145 in the micro switch 140.

In an embodiment, the restoring member 145 can be a compression spring, but the disclosure is not limited in this regard. In other embodiments, the restoring member 145 can also be an elastic rubber hollow cone or a magnetic element to provide a restoring force.

From the aforementioned details of the embodiments of the disclosure, obviously, in the keyswitch device and the keyboard of the disclosure, it is the micro switch used to support the keycap and generating pressing signals correspondingly while the keycap is pressed, so the micro switch can replace the membrane circuit and the restoring member in the conventional keyswitch device. Moreover, in the keyswitch device and the keyboard of the disclosure, there is a hook designed on the fixing bracket to hook downward to the circuit board, thus the conventional adhesive layer used to fix the circuit board and the fixing bracket can be omitted. Furthermore, the keyswitch device and the keyboard in the disclosure, there is a hook designed on the fixing bracket to hook into the positioning hole set up on the micro switch, so as to prevent the micro switch disposed on the circuit board from floating and skewing. Also, a grounding pad 115 can be disposed on the location where the circuit board is hooked by the hook of the fixing bracket to add some additional properties such as grounding and anti-static.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A keyswitch device, comprising:

a circuit board having a first surface and a second surface opposite to the first surface, and the circuit board comprises a through hole communicating the first surface and the second surface;

a fixing bracket comprising:

a main body abutting against the first surface;

a first hook connected to the main body and fixed to the circuit board, and the first hook abuts against the second surface via the through hole, and the main body slidably abuts against the first surface, so as to make the first hook selectively abut against or leave the second surface; and a second hook:

a micro switch disposed on the circuit board, passing through the main body and configured to generate a pressing signal to the circuit board while being pressed, and the micro switch comprises:

a pedestal disposed on the circuit board and having a positioning hole; and a push button supporting the keycap and engaged with the pedestal, the push button being configured to move toward or away from the pedestal, wherein the second hook is engaged with the positioning hole when the first hook abuts against the second surface, and the second hook is separated from the positioning hole when the first hook is separated from the second surface;

a keycap supported on the micro switch and configured to press the micro switch toward the circuit board; and a connecting assembly connected between the fixing bracket and the keycap and configured to guide the keycap to move upward and downward relatively to the circuit board.

2. The keyswitch device of claim 1, wherein the first hook and the second hook are located at opposite sides of the main body.

3. The keyswitch device of claim 1, wherein the positioning hole is located at a peripheral edge of the pedestal.

4. The keyswitch device of claim 1, wherein the circuit board further has an engaging hole and the engaging hole is configured to engage with the peripheral edge of the pedestal.

5. The keyswitch device of claim 1, wherein the fixing bracket further comprises a plurality of third hooks connected to the main body and configured to be engaged with the connecting assembly.

6. The keyswitch device of claim 1, wherein the push button has an abutting portion extending toward the pedestal, and the micro switch further comprises:

a first terminal disposed on the pedestal and electrically connected to the circuit board; and a second terminal disposed on the pedestal, electrically connected to the circuit board, and opposite to the first terminal, wherein when the push button moves toward the pedestal to make the abutting portion abut against the second terminal, the second terminal is then moved toward the first terminal to electrically connect to the first terminal, so as to generate a pressing signal.

7. The keyswitch device of claim 1, wherein the micro switch further comprises:

a restoring member disposed between the pedestal and the push button.

8. The keyswitch device of claim 1, wherein the fixing bracket comprises metal, the circuit board further comprises a grounding pad disposed on the second surface and adjacent to the through hole, and the grounding pad is configured to electrically contact the first hook abutting against the second surface.

9. A keyboard, comprising:

a circuit board having a first surface and a second surface opposite to the first surface, and the circuit board comprises a plurality through holes communicating the first surface and the second surface; and a plurality of keyswitch assemblies, each of the keyswitch assemblies comprising:

a fixing bracket, comprising:

a main body abutting against the first surface;

a first hook connected to the main body and fixed to the circuit board, and the first hook abuts against the second surface via the corresponding through hole, and the main body slidably abuts against the first surface, so as to make the first hook selectively abut against or leave the second surface; and a second hook;

a micro switch disposed on the circuit board passing through the main body and configured to generate a pressing signal to the circuit board while being pressed, and the micro switch comprises:

a pedestal disposed on the circuit board and having a positioning hole; and a push button supporting the keycap and engaged with the pedestal, the push button disposed to move toward or away from the pedestal, wherein the second hook engages with the positioning hole when the first hook abuts against the second surface and the second hook is separated from the positioning hole when the first hook is separated from the second surface;

a keycap supported on the micro switch and configured to press the micro switch toward the circuit board, and a connecting assembly connected between the fixing bracket and the keycap and configured to guide the keycap to move upward and downward relative to the circuit board.

10. The keyboard of claim 9, wherein the first hook and the second hook are located at the opposite sides of the main body.

11. The keyboard of claim 9, wherein the positioning hole is located at a peripheral edge of the pedestal.

12. The keyboard of claim 9, wherein the circuit board further comprises a plurality of engaging holes, and each of the engaging holes is configured to engage with the peripheral edge of the pedestal of the corresponding micro switch.

13. The keyboard of claim 9, wherein the fixing bracket further comprises a plurality of third hooks connected to the main body and configured to be engaged with the connecting assembly.

14. The keyboard of claim 9, wherein the push button has an abutting portion extending toward the pedestal, and the micro switch further comprises:

a first terminal disposed on the pedestal and electrically connected to the circuit board; and a second terminal disposed on the pedestal, electrically connected to the circuit board and opposite to the first terminal, wherein when the push button moves toward the pedestal to make the abutting portion abut against the second terminal, the second terminal is then moved toward the first terminal to electrically connect to the first terminal, so as to generate a pressing signal.

15. The keyboard of claim 9, wherein the micro switch further comprises:

a restoring member disposed between the pedestal and the push button.

16. The keyboard of claim 9, wherein the fixing bracket comprises metal, the circuit board further comprises a grounding pad disposed on the second surface and adjacent the through hole, and the grounding pad is configured to electrically contact the first hook abutting against the second surface.

17. A keyswitch device, comprising:

a circuit board having a first surface and a second surface opposite to the first surface, and the circuit board comprises a through hole communicating the first surface and the second surface;

a fixing bracket comprising:

a main body abutting against the first surface; and a first hook connected to the main body and fixed to the circuit board, and the first hook abuts against the second surface via the through hole, and the main body slidably abuts against the first surface, so as to make the first hook selectively abut against or leave the second surface;

a micro switch disposed on the circuit board, passing through the main body and configured to generate a pressing signal to the circuit board while being pressed;

a keycap supported on the micro switch and configured to press the micro switch toward the circuit board; and a connecting assembly connected between the fixing bracket and the keycap and configured to guide the keycap to move upward and downward relatively to the circuit board, and wherein the fixing bracket comprises metal, the circuit board further comprises a grounding pad disposed on the second surface and adjacent to the through hole, and the grounding pad is configured to electrically contact the first hook abutting against the second surface.

18. The keyswitch device of claim 17, wherein the fixing bracket further comprises a second hook and the micro switch comprises:

a pedestal disposed on the circuit board and having a positioning hole; and a push button supporting the keycap and engaged with the pedestal, the push button being configured to move toward or away from the pedestal, wherein the second hook is engaged with the positioning hole when the first hook abuts against the second surface, and the second hook is separated from the positioning hole when the first hook is separated from the second surface.

19. The keyswitch device of claim 17, wherein the first hook and the second hook are located at opposite sides of the main body.

20. The keyswitch device of claim 17, wherein the positioning hole is located at a peripheral edge of the pedestal.

21. The keyswitch device of claim 17, wherein the circuit board further has an engaging hole and the engaging hole is configured to engage with the peripheral edge of the pedestal.

22. The keyswitch device of claim 17, wherein the fixing bracket further comprises a plurality of third hooks connected to the main body and configured to be engaged with the connecting assembly.

23. The keyswitch device of claim 17, wherein the push button has an abutting portion extending toward the pedestal, and the micro switch further comprises:

a first terminal disposed on the pedestal and electrically connected to the circuit board; and a second terminal disposed on the pedestal, electrically connected to the circuit board, and opposite to the first terminal, wherein when the push button moves toward the pedestal to make the abutting portion abut against the second terminal, the second terminal is then moved toward the first terminal to electrically connect to the first terminal, so as to generate a pressing signal.

24. The keyswitch device of claim 17, wherein the micro switch further comprises:

a restoring member disposed between the pedestal and the push button.

25. A keyboard, comprising:

a circuit board having a first surface and a second surface opposite to the first surface, and the circuit board comprises a plurality through holes communicating the first surface and the second surface; and a plurality of keyswitch assemblies, each of the keyswitch assemblies comprising:

a fixing bracket, comprising:

a main body abutting against the first surface; and a first hook connected to the main body and fixed to the circuit board, and the first hook abuts against the second surface via the corresponding through hole, and the main body slidably abuts against the first surface, so as to make the first hook selectively abut against or leave the second surface;

a micro switch disposed on the circuit board passing through the main body and configured to generate a pressing signal to the circuit board while being pressed;

a keycap supported on the micro switch and configured to press the micro switch toward the circuit board; and a connecting assembly connected between the fixing bracket and the keycap and configured to guide the keycap to move upward and downward relative to the circuit board, and wherein the fixing bracket comprises metal, the circuit board further comprises a grounding pad disposed on the second surface and adjacent the through hole, and the grounding pad is configured to electrically contact the first hook abutting against the second surface.

26. The keyboard of claim 25, wherein the fixing bracket further comprises a second hook and the micro switch comprises:

a pedestal disposed on the circuit board and having a positioning hole; and a push button supporting the keycap and engaged with the pedestal, the push button disposed to move toward or away from the pedestal, wherein the second hook engages with the positioning hole when the first hook abuts against the second surface, and the second hook is separated from the positioning hole when the first hook is separated from the second surface.

27. The keyboard of claim 25, wherein the first hook and the second hook are located at the opposite sides of the main body.

28. The keyboard of claim 25, wherein the positioning hole is located at a peripheral edge of the pedestal.

29. The keyboard of claim 25, wherein the circuit board further comprises a plurality of engaging holes, and each of the engaging holes is configured to engage with the peripheral edge of the pedestal of the corresponding micro switch.

30. The keyboard of claim 25, wherein the fixing bracket further comprises a plurality of third hooks connected to the main body and configured to be engaged with the connecting assembly.

31. The keyboard of claim 25, wherein the push button has an abutting portion extending toward the pedestal, and the micro switch further comprises:

a first terminal disposed on the pedestal and electrically connected to the circuit board; and a second terminal disposed on the pedestal, electrically connected to the circuit board and opposite to the first terminal, wherein when the push button moves toward the pedestal to make the abutting portion abut against the second terminal, the second terminal is then moved toward the first terminal to electrically connect to the first terminal, so as to generate a pressing signal.

32. The keyboard of claim 25, wherein the micro switch further comprises:

a restoring member disposed between the pedestal and the push button.

* * * * *